US005666620A

United States Patent [19]

Kobayashi

[11] Patent Number: 5,666,620

[45] Date of Patent: Sep. 9, 1997

[54] DEVELOPING DEVICE FOR PEELING TONER USING PEELING ROTARY MEMBER

[75] Inventor: Yoshiaki Kobayashi, Soka, Japan

[73] Assignee: Canon Kabushiki Kaisha, Tokyo, Japan

[21] Appl. No.: 670,107

[22] Filed: Jun. 25, 1996

Related U.S. Application Data

[63] Continuation of Ser. No. 359,730, Dec. 20, 1994, abandoned.

[30] Foreign Application Priority Data

Dec. 22, 1993 [JP] Japan ..... 5-345553
Dec. 24, 1993 [JP] Japan ..... 5-347982

[51] Int. Cl.[6] ..... G03G 15/09

[52] U.S. Cl. ..... 399/273; 399/283

[58] Field of Search ..... 399/273, 272, 399/274, 275, 276, 277, 267, 283

[56] References Cited

U.S. PATENT DOCUMENTS 4,386,577 6/1983 Hosono et al. ..... 118/657
4,572,631 2/1986 Kondo .
4,806,992 2/1989 Yasuda et al. .
5,075,728 12/1991 Kobayashi et al. ..... 355/260
5,086,728 2/1992 Kinoshita ..... 355/260 X
5,177,537 1/1993 Okano et al. ..... 355/259
5,287,150 2/1994 Kinoshita et al. ..... 355/259
5,311,264 5/1994 Kinoshita ..... 355/259
5,324,884 6/1994 Honda et al. ..... 355/259

FOREIGN PATENT DOCUMENTS 4223910 11/1942 Japan .
58-116559 7/1983 Japan .

*Primary Examiner*—R. L. Moses
*Attorney, Agent, or Firm*—Fitzpatrick, Cella, Harper & Scinto

[57] ABSTRACT

A developing device for a copying machine, a printer, a facsimile apparatus, and the like, includes a developing container for containing a toner added with an additive, a toner carrier which is arranged in an opening portion of the developing container and is rotated while carrying the toner, and a peeling member which is in sliding contact with the toner carrier and peels the toner on the toner carrier. The triboelectric charging potential difference between the surface of the peeling member and the additive is substantially zero.

28 Claims, 5 Drawing Sheets

DEVELOPING DEVICE FOR PEELING TONER USING PEELING ROTARY MEMBER

This application is a continuation of application Ser. No. 08/359,730, filed Dec. 20, 1994, abandoned.

BACKGROUND OF THE INVENTION

1. Field of the Invention

The present invention relates to a developing device which is used in an image forming apparatus such as a copying machine, a printer, or the like, and develops an electrostatic image on an image carrier.

2. Related Background Art

In an image forming apparatus such as a copying machine, an image display apparatus, an image recording apparatus, a printer, a facsimile apparatus, or the like, a latent image formed on an image carrier, which comprises, e.g., an electrophotographic photosensitive body, an electrostatic recording dielectric member, or the like, is developed by a developing device and visualized as a toner image.

As an example of developing devices, various dry, one-component developing devices have been proposed and put into practical use. However, it is very difficult for these developing devices to form a toner thin layer of a one-component developing agent on a developing agent carrier. Since such a thin toner layer is currently required to improve sharpness, resolution, and the like of images, further development associated with a method of forming a thin toner layer and its associated apparatus is indispensable. Various proposals have been made to satisfy the above-mentioned requirements.

For example, a magnetic one-component toner has been used, a developing sleeve whose surface is subjected to blasting using regular particles to form a smooth surface having a relatively smooth three-dimensional pattern, and a magnetic blade which is arranged with a predetermined gap from the sleeve, all have used to form an appropriately triboelectrically charged thin toner layer on the sleeve.

In order to achieve higher image quality and a quick start of a copying operation, if a toner having a small particle size and a low melting point is used, a then blocking phenomenon of the toner easily may occur in the vicinity of the magnetic blade since the toner has a higher degree of agglomeration than that of a conventional toner, thereby resulting in considerably nonuniform or fogged images in a high-humidity environment. Also, in a low-humidity environment, the toner locally agglomerates and becomes attached (a blotch phenomenon) onto the sleeve due to a charge-up phenomenon in addition to the blocking phenomenon, and often appears on an image.

As a countermeasure against the above-mentioned phenomena, as described in U.S. Pat. No. 4,386,577, an elastic blade consisting of a rubber, resin, or metal material is kept in contact with the developing sleeve at a low pressure, and regulates thickness of a toner layer while removing the toner cohered on the sleeve by the contact portion, thus realizing formation of a uniform thin toner layer. In addition, since the upper and lower toner layers on the developing sleeve can be sufficiently triboelectrically charged by the blade, a high-quality image free from nonuniformity, fogging, and the like, can be produced.

However, upon replenishment of toner after continuous copying operations for tens of thousands of copies, a toner agglomerate locally clogs the contact portion between the elastic blade and the sleeve, thus causing coating nonuniformity of coating the of toner onto the sleeve.

In addition, the toner fuses on the contact surface of the elastic blade, and triboelectric charging performance of the toner is lowered.

In order to solve these problems, a roller which consists of open-cell polyurethane foam or and a fur brush structure and is rotated while contacting the sleeve at a position upstream in the sleeve rotational direction in the vicinity of the developing sleeve and the magnetic blade, so that toner adhered to the sleeve is swung by the contact portion and easily removed from the sleeve. At the same time, the toner is triboelectrically charged. In addition, the blocking toner in the vicinity of the blade imparts flowability upon rotation of the roller and can therefore maintain high fluidity. As a result, in the above-mentioned elastic blade system, a high-quality image free from blocking, nonuniformity, fogging, and the like can be produced.

Since an open-cell sponge roller suffers from a problem of a decrease in toner coating/removal performance of the roller or disintegration of the sponge roller (or a fur brush) caused by the roller which is hardened by the toner clogging inside the open-cell sponge roller, a developing device described in U.S. patent application No. 280,796 has been proposed. When a toner supply roller consists of closed-cell foam rubber free from internal toner clogging, the toner coating/removal performance with respect to the sleeve, and triboelectric charging performance of the toner can be satisfactorily maintained after copying operations of tens of thousands of copies even though the actual contact area increases as compared to an open-cell roller if the entrance amount of the toner to the sleeve remains the same.

On the other hand, when a non-magnetic toner is used, since a magnetic force cannot be used like in a magnetic toner, an arrangement described in, e.g., Japanese Laid-Open Patent Application No. 58-116559 has been proposed. More specifically, in this arrangement, the thickness of a toner layer on the sleeve is regulated by keeping the elastic blade in contact with the sleeve. A supply roller with a fur brush structure as a developing agent supply/peeling means is kept in rotatable contact with a portion on the upstream side in the sleeve rotational direction of the contact portion. With this arrangement as well, when the supply roller consists of a closed-cell foam roller, high-quality images can be stably provided even after continuous copying operations over a long period of time, as in the above-mentioned magnetic toner.

However, with a trend toward a higher resolution of a latent image in an image forming apparatus, reliance on the particle size of the toner as a developing agent is decreasing as a way to faithfully reproduce a high-resolution latent image, and the following problems arise.

More specifically, when the toner has a smaller particle size (becomes finer particles), the charge amount per unit area increases, and the degree of agglomeration increases at the same time. When toner in this state is supplied to a developing device to perform a copying operation, the toner clogs in the vicinity of the developing sleeve (blocking phenomenon), or coheres to the surface of the sleeve (blotch phenomenon).

In order to avoid these phenomena, a fine silica powder is externally added as a fluidity holding member in a quantity more than that added to a conventional toner so as to prevent an increase in degree of agglomeration.

However, when long-term copying operations are performed using a magnetic toner to which a large amount of the above-mentioned fine powder is externally added in the above-mentioned conventional system including the magnetic blade and the closed-cell supply roller, a decrease in density and generation of fogging gradually occur.

When the developing device was examined after an image output operation, it was found that the base layer portion of the surface of the closed-cell toner supply roller was cloudy. As a result of quantitative analysis of the composition of the cloudy portion, the cloudy portion included the silica as an external additive and the toner, and the weight % of the silica was abnormally larger than that in the initial state.

This phenomenon is caused by a difference between the charging systems of the silica in the toner and the closed-cell roller.

Normally, when a positive toner is used, positive silica is externally added; when a negative toner is used, negative silica is externally added, thereby preventing a decrease in charge amount of the toner due to addition of the external additive. Therefore, the toner and silica attract each other by a force such as an intermolecular force other than an electrostatic force. The closed-cell roller normally has an electrification polarity opposite to that of the toner so as to triboelectrically charge the toner using the contact portion between itself and the sleeve. In other words, the polarity of the silica is opposite to that of the closed-cell roller. When a copying operation is continued in this arrangement, since the amount of externally added silica is larger than that in the conventional toner, silica which cannot become attached to the toner surface with a strong force gradually coheres on the surface of the closed-cell roller electrostatically. As a result, the surface of the closed-cell roller is silica-coated, and the physical properties and shape of the surface change, resulting in a decrease in coating/removing performance of the supply roller. For this reason, since the charging characteristics and the like of the toner on the sleeve change from those in an initial state, a decrease in density, fogging, and the like occur. Such a phenomenon similarly occurs when a non-magnetic toner is used.

On the outer surface of the developing sleeve, as one constituent element of the developing device, a three-dimensional roughened surface is formed by, e.g., sand blasting for the purpose of improving toner carriability. In this case, since the closed-cell supply roller contacts the sleeve, a three-dimensional pattern finer than that in a system to which no roller contacts the sleeve can provide sufficient performance due to the coating effect.

When the present inventors conducted durability tests by outputting one million images using fine toner particles having a toner particle size of 6 μm or less, the following problems were additionally posed.

(1) When a SUS (stainless steel) developing sleeve was used, its surface was subjected to sand blasting using regular beads to obtain a surface roughness Rz=3.0 μm, and an image output operation was performed in a low-humidity environment where the initial solid black reflection density was 1.5, the absolute value of the charge amount of the toner on the sleeve was 20 μc/g, and the weight per unit area of the toner on the sleeve (to be referred to as M/S hereinafter) was 1.4 mg/cm$^2$. Thereafter, when several thousand images were output, the solid density became 1.2, the toner charge amount became 8 μc/g, the M/S became 1.7 mg/cm$^2$, and the amount of toner attached to a non-image portion (to be referred to as fogging hereinafter) increased. However, when the image output operations were further continued, the density and fogging were improved. When five hundred thousand images were output, the density became 1.4 to 1.5, the charge amount became 20 μc/g, the M/S became 1.0 mg/cm$^2$, and the one millionth image was output in this state. In the latter half of the image output durability tests, several stripe-shaped portions on which no toner was attached were generated in the sleeve rotational direction (this phenomenon will be referred to as "white stripe" hereinafter).

(2) An Al sleeve was used, its surface was subjected to the same surface roughening treatment as in (1), and image output operations were similarly performed. As a result, when several thousand images were output, a decrease in density, fogging, and white stripes were similarly observed. Thereafter, in this case as well, the density and fogging were improved, and stable image quality was maintained after the ten thousandth image.

When the cause of the above-mentioned phenomenon was examined, it was found that a decrease in density and an increase in fogging after image output operations of several thousand images in the case of the SUS sleeve were caused by a decrease in triboelectric charging performance from the sleeve to the toner and an increase in M/S due to finer particles in the fine toner particles, which cohered on small recess portions of the three-dimensional roughened surface of the sleeve.

The reason why the density and fogging were improved later was as follows. That is, as the number of times of sliding contact between the closed-cell roller and the sleeve increased, the three-dimensional pattern on the surface of the sleeve gradually was wore and smoothed, and the toner cohered on the surface was removed together with the worn powder of the sleeve. As a result, the toner charge amount increased, and carriability was stabilized.

Since the Al sleeve was softer than the SUS sleeve, its surface wore earlier than that of the SUS sleeve, and hence, the density and the like were improved earlier than the SUS sleeve.

Note that white stripes in the circumferential direction of the developing sleeve were generated since coarse particles of the worn powder of the sleeve were deposited between the magnetic blade and the sleeve.

SUMMARY OF THE INVENTION

It is an object of the present invention to provide a developing device with stable charging characteristics over a long period of time.

It is another object of the present invention to provide an image forming apparatus which can prevent the surface of a peeling rotary member, for peeling toner from a toner carrier, from being coated with an additive.

It is still another object of the present invention to provide a developing device comprising:

a developing container for containing a toner added with an additive;

a toner carrier which is arranged in an opening portion of the developing container and is rotated while carrying the toner; and a peeling member which is in sliding contact with the toner carrier and peels the toner on the toner carrier, wherein a triboelectric charging potential difference between the surface of the peeling member and the additive is substantially zero.

It is still another object of the present invention to provide a developing device comprising:

a developing container for containing a toner including silica;

a toner carrier which is arranged in an opening portion of the developing container and is rotated while carrying the toner; and a peeling member which is in sliding contact with the toner carrier and peels the toner on the toner carrier, wherein the peeling member has a surface layer in which silica is dispersed.

Other objects of the present invention will become apparent from the following description.

DESCRIPTION OF THE PREFERRED EMBODIMENTS

<EXAMPLE 1>

Figure 1:
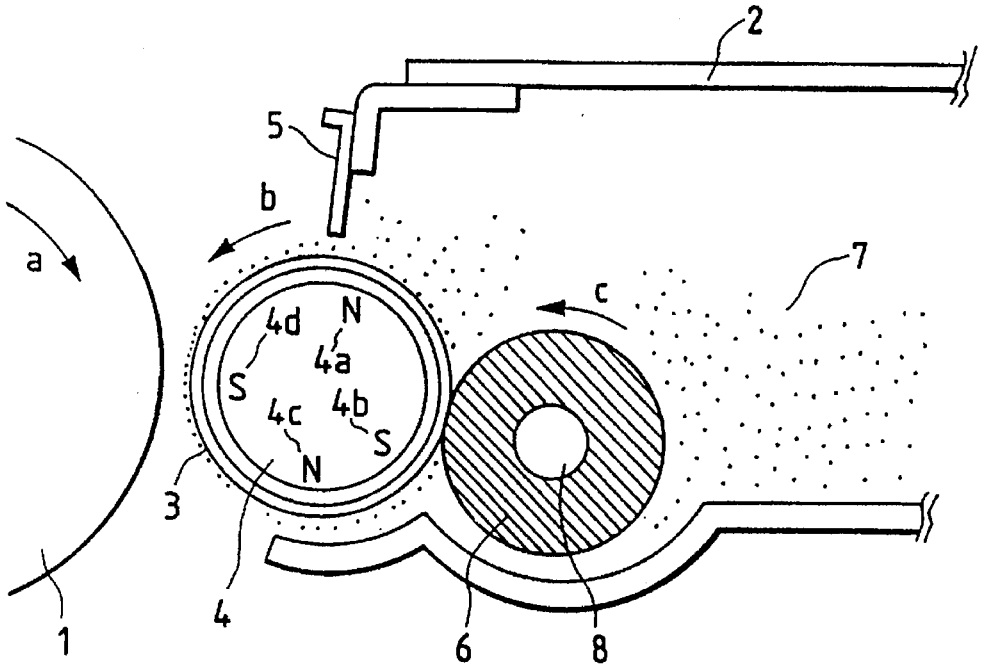
FIG. 1 is a schematic sectional view of a developing device according to Example 1 of the present invention.

Example 1 of the present invention will be described below with reference to FIGS. 1 and 2. FIG. 1 is a schematic sectional view showing a developing device according to an example of the present invention. Referring to FIG. 1, a developing container 2 contains a magnetic toner 7 as a one-component developing agent and an external additive such as silica as a fluidity holding member. The developing device of this example comprises the developing container 2, a developing sleeve 3 as a toner carrier, which is arranged to face a photosensitive body 1 rotated in the direction of an arrow a in FIG. 1, and includes a magnet 4 as a magnetic field generating means. The developing sleeve 3 develops an electrostatic latent image on the photosensitive body 1 to visualize it as a toner image.

The photosensitive body 1 may be, for example, a so-called xerography photosensitive body which forms an electrostatic latent image by a Carlson process, a photosensitive body which forms an electrostatic latent image by an NP process described in Japanese Laid-Open Patent Application No. 42-23910 and has an insulative layer on its surface, an insulative body which forms an electrostatic latent image by an electrostatic recording method, an insulative body which forms an electrostatic latent image by a transfer method, or members which form an electrostatic latent image (including a potential latent image) by other proper methods.

The developing container 2 has an opening portion extending in the longitudinal direction (in a direction perpendicular to the plane of the drawing of FIG. 1) of the developing device, and the above-mentioned developing sleeve 3 is arranged in the opening portion.

The developing sleeve 3 consists of, e.g., aluminum, stainless steel, or the like, and is rotatably arranged to face the photosensitive body 1, so that its right half outer circumferential surface in FIG. 1 extends into the developing container 2 via the opening, and its left half outer circumferential surface is exposed outside the developing container 2. A small gap is formed between the developing sleeve 3 and the photosensitive body 1. The developing sleeve 3 is rotated in the direction of an arrow b with respect to the rotational direction a of the photosensitive body 1. The toner carrier is not limited to a cylindrical member (sleeve) like the developing sleeve 3, but may be an endless belt which is rotated. Also, a conductive rubber roller may be used.

The magnet 4 is arranged in the developing sleeve 3, and comprises a fixed permanent magnet in this example. Even when the sleeve 3 is rotated, the magnet 4 maintains its fixed position and posture, and generates a fixed magnetic field.

Furthermore, in the developing container 2, a magnetic blade 5 as a toner regulating member is arranged, so that its edge portion is located in the vicinity of a position above the developing sleeve 3. In addition, a toner supply roller 6 consisting of closed-cell foam rubber is rotatably arranged at a position, at the upstream side in the rotational direction of the developing sleeve 3, of the magnetic blade 5. In the above-mentioned arrangement of the developing device, the supply roller 6 is rotated in the direction of an arrow c in FIG. 1, and the magnetic toner 7 is supplied to the vicinity of the sleeve 3 by the rotation of the supply roller 6 and application of a magnetic field by the magnet in the sleeve 3. When the magnetic toner 7 is brought into sliding contact with the supply roller 6 and the sleeve 3 in a nip portion where the sleeve 3 contacts the supply roller 6, the toner 7 is sufficiently triboelectrically charged, and is attached onto the sleeve 3 by an electrostatic force due to the triboelectric charging and the magnetic force from the magnet in the sleeve 3.

Thereafter, upon rotation of the developing sleeve 3, the magnetic toner attached to the developing sleeve 3 leaves a magnetic regulating portion formed in a gap between the magnetic blade 5 and the developing sleeve 3, and forms a thin layer of magnetic toner on the developing sleeve 3. The thin toner layer is conveyed to a developing portion which faces the photosensitive body 1 with a small gap therebetween. When an alternate voltage obtained by superposing an AC voltage on a DC voltage is applied as a developing bias across the developing sleeve 3 and the photosensitive body 1 on the developing portion, the magnetic toner 7 on the developing sleeve 3 is transferred in correspondence with an electrostatic latent image on the photosensitive body 1, and becomes attached to and develops the electrostatic latent image thereon, thus visualizing the latent image as a toner image. The magnetic toner 7 which remains on the developing sleeve 3 without being consumed by the developing process on the developing portion is recovered into the developing container 2 by the lower portion of the developing sleeve 3 upon rotation of the developing sleeve 3. The recovered toner 7 is removed from the developing sleeve by the supply roller, i.e., its contact portion with the developing sleeve. At the same time, a new portion of magnetic toner is supplied onto the developing sleeve upon rotation of the supply roller, and the new portion of toner is conveyed to the vicinity of the magnetic blade upon rotation of the developing sleeve. On the other hand, most of the removed toner portion is conveyed into the toner portion in the developing container 2 upon rotation of the supply roller, and is mixed therein, thereby dispersing triboelectric charges on the removed toner.

The developing agent in this example will be described in detail below. The magnetic toner 7 is used as a magnetic one-component developing agent, and is prepared by dispersing a coloring agent and a magnetic member such as ferrite in various thermoplastic resins such as a styrene resin, an acrylic resin, a polyester resin, and the like.

In this example, a negatively chargeable polyester resin having an average particle size of 6 μm is used as a binder. As a fluidity holding member, 1.2 wt % of negatively chargeable silica subjected to a hydrophobic treatment is externally added.

The closed-cell toner supply roller in this example will be described in detail below. The closed-cell roller as the toner supply roller is prepared by covering, in a roller shape, a closed-cell foam in which the wall surface of one cell does not communicate with a neighboring cell around a metal core 8 as a support shaft. The supply roller is rotated in the direction of the arrow c in FIG. 1 and is in sliding contact with the developing sleeve. Since the toner supply roller consisting of closed-cell foam rubber (to be simply referred to as a closed-cell roller hereinafter) is used, the actual contact area can be increased as compared to a conventional open-cell roller or fur-brush roller since its surface is dense, even when the entrance amount of toner to the developing sleeve remains the same. As a result, the toner coating/removing operation with respect to the sleeve can be satisfactorily performed.

The closed-cell roller in this example is formed by foaming a silicone rubber compound in which 10 wt % of negatively chargeable silica, which is externally added to the developing agent, is dispersed as a filler. As a result, the silica is dispersed on the surface of the foamed closed-cell roller, and some silica particles are exposed on the surface. In order to examine a charge potential difference between the closed-cell roller and the silica in the developing agent, after silica is coated on the surface of the closed-cell roller, the silica is completely peeled by air, and the potential of the roller surface after peeling is measured by a surface electrometer available from Trek Corp. As a result, the measured values fall within a range of −20 to +20 V. As can be understood from these results, the potential difference between the silica in the developing agent and the closed-cell roller surface in this example is substantially zero. In contrast to this, as a comparative example, when a closed-cell roller in which no silica is externally added to the developing agent is used, and the charge potential difference between the roller and the silica in the developing agent used in the example is measured by the same measuring method as described above, the measured values fall within a range from +1,000 to +1,200 V.

Figure 2:
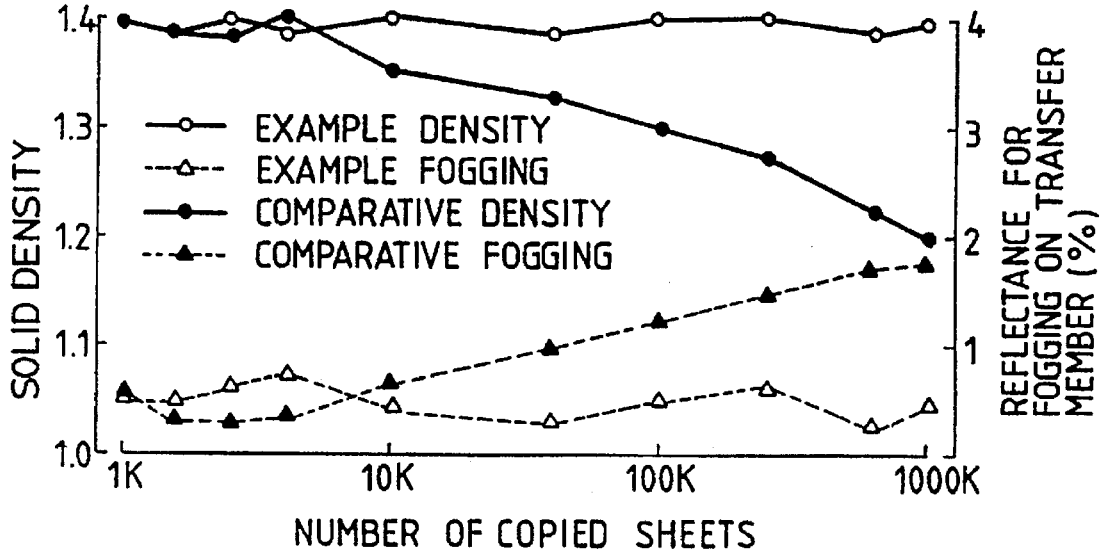
FIG. 2 is a graph showing changes in solid density and reflectance for fogging upon conduction of image output durability tests of one million images in the developing device according to Example 1 of the present invention and a developing device according to a comparative example.

FIG. 2 shows changes in solid density and reflectance for toner attachment (fogging) on a non-image portion when one million copying operations are performed in the arrangements of the above two examples. As shown in FIG. 2, in the present example, the density and the reflectance for fogging have satisfactory values, while in the comparative example, a decrease in density and an increase in reflectance for fogging occurred, and a silica-rich toner cohered on the surface of the closed-cell roller.

The charge amount of the developing agent on the sleeve is satisfactory, i.e., −20 μc/g in the beginning in this example. This is because the developing agent is triboelectrically charged by the sleeve upon sliding contact at the contact portion between the sleeve and the closed-cell roller.

In this example, silica is used as an external additive to the developing agent, and a silicone rubber sponge in which the silica is dispersed as a filler is used as the closed-cell roller. However, the present invention is not limited to this. For example, the closed-cell roller may consist of another material such as a non-filler type closed-cell rubber sponge as long as the contact triboelectric charge potential difference between the external additive and the surface of the closed-cell roller is substantially zero.

For example, when a polyvinylidene fluoride fine powder with strong negative characteristics is used as an external additive to the developing agent, the fine powder may be dispersed in a rubber compound and may be foamed. In addition a fluorine rubber sponge having strong negative characteristics equivalent to those of polyvinylidene fluoride may be used.

The contact conditions of the closed-cell roller in the arrangement of this example, i.e., in a system for regulating the thickness of a toner layer on the sleeve by the magnetic blade by utilizing a magnetic field generated by a magnet roller in the sleeve and coating/removing a toner onto/from the sleeve by the closed-cell roller will be described below.

According to the experiments of the present inventor, in contrast with an allowable range in a system which does not use the effect of the magnet roller (especially, in a system using a non-magnetic toner), the present invention allows toner coating based on a magnetic force upon operation of the magnet roller and toner removal by utilizing a difference in magnetic force on the sleeve surface. Therefore, the allowable range can be widened, or a range which does not easily cause adverse effects can be set.

More specifically, the following conditions can be set:

(a) Contact width with sleeve: 0.5 to 6.0 mm (b) Roller density: 0.15 to 0.35 g/cm$^3$ (c) Roller hardness (ASKER-C, 300 g weight): 10° to 30°

(d) Number of cells on roller surface: 100 to 400 cells/inch

As for condition (a), when the contact width becomes smaller than 0.5 mm, coating nonuniformity occurs, and conversely, when the contact width becomes larger than 6.0 mm, problems of toner fusion onto the sleeve and an increase in driving torque are posed. As for condition (c), if the roller hardness becomes smaller than 10°, the sleeve is easily contaminated with leaked low-molecular oil. On the other hand, when the roller hardness becomes larger than 30°, toner fusion on the sleeve and an increase in driving torque occur due to an excessive contact force. As for conditions (b) and (d), the ranges are determined for the same reasons.

In the closed-cell roller of this example, a roller which had an outer diameter of 14 mm was prepared by covering a 4-mm thick closed-cell foam roller having a hardness of 12° (ASKER-C, 300 g weight), a density of 0.25 g/cm$^3$, and 200 cells/inch around a metal core having an outer diameter of 6 mm. The roller was rotated in the same direction as that of the sleeve at the same speed as that of the sleeve and contacted the sleeve by a contact width of 4.0 mm.

Other arrangements in this example will be described below. First, on the surface of the above-mentioned developing sleeve, a proper three-dimensional roughened surface is formed, thereby improving carriability of a toner. In a developing device which does not use a closed-cell roller of the present invention, the roughness of the three-dimensional roughened surface cannot be set to be so fine as to prevent a decrease in the carrying force of the toner and to prevent a blotch phenomenon, e.g., a local abnormal charge-up on a given portion of toner on the sleeve. As a result, in a high-humidity environment, fogging occurs due to insufficient triboelectric charging performance. However, in the present invention, even when the sleeve surface roughness is set to be fine, the blotch phenomenon can be reliably prevented by the effect of the closed-cell roller. In addition, since the mechanical cohesive force of the toner to the sleeve is improved, the decrease in carrying force can be prevented. Hence, the sleeve surface roughness can be set to be finer due to a further improvement of triboelectric charging performance. The three-dimensional roughened surface is obtained by performing a sand blasting treatment using amorphous alundum abrasive particles or performing a send blasting treatment using regular glass beads, so as to have a surface roughness Rz of 1 to 5 μm. Alternatively, for example, metal oxide particles, or conductive particles such as graphite, carbon or the like, which can independently form projecting portions, may be used to form a roughened surface with projecting portions on the surface of the developing sleeve. The particles, which form the roughened surface with projecting portions, may be bound by a binder resin such as a fluorine resin, such that the surface of the binder resin forms recess portions, thereby obtaining a three-dimensional roughened surface on the surface of the developing sleeve.

In this example, the developing sleeve uses an SUS sleeve having a diameter of 20 mm as a base, and the surface of the SUS sleeve is subjected to a blasting treatment using regular glass beads (#400) to have a surface roughness Rz of about 1.5 μm.

The developing agent layer thickness regulating member on the sleeve, in this example, is a metal magnetic cut blade whose edge portion is arranged in the vicinity of the sleeve and utilizes a magnetic field generated by the magnet in the sleeve. Alternatively, an elastic blade, which regulates the thickness of a developing agent layer on the sleeve by keeping a rubber or metal thin plate in elastic contact with the sleeve at a low pressure, may be used.

The developing device with the above-mentioned arrangement was assembled in a GP-55 copying machine available from CANON INC., and a non-contact developing operation was performed under the conditions where a voltage obtained by superposing a DC voltage of −550 V on an AC voltage having a frequency of 2,000 Hz and a peak-to-peak voltage of 1,400 V was used as a bias power supply, the surface potential of a light portion of a latent image on the photosensitive drum 1 was set to be −700 V, and that of a dark portion was set to be −250 V. The interval between the developing sleeve 3 and the photosensitive drum 1 was set to be 300 μm. As a result, a satisfactory thin toner layer could be uniformly formed on the developing sleeve, and a good image with a reflection density of 1.4 could be obtained. At this time, the charge amount of the toner was −20 μc/g, and this value is satisfactory.

Furthermore, when one million image forming operations were continuously performed while replenishing the toner for each 3,000 sheets, high-quality images free from density nonuniformity, fogging, decreases in density, and the like could be maintained up to the last image forming operation as well as upon replenishment of the toner.

<EXAMPLE 2>

Figure 3:
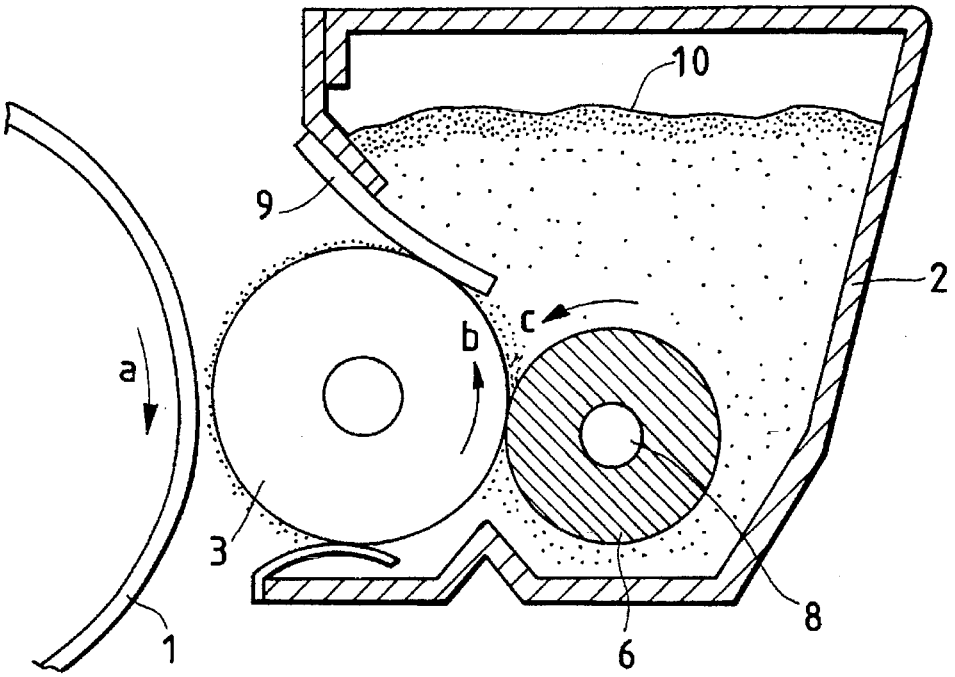
FIG. 3 is a schematic sectional view of a developing device according to Example 2 of the present invention.

Example 2 of the present invention will be described below with reference to FIG. 3. A developing agent in this example adopts a non-magnetic one-component developing agent 10 consisting of a thermoplastic resin binder, a coloring agent, and silica. In the arrangement of a developing device, as shown in FIG. 3, since a magnetic cut blade cannot be used as a developing agent thickness regulating member on a sleeve as in Example 1, an elastic member 9 made of a rubber or thin plate metal is in contact with the surface of the sleeve at a low pressure. A closed-cell roller as a toner supply roller is prepared by dispersing the same silica as that in the developing agent as a filler as in Example 1.

Since the non-magnetic developing agent does not contain any magnetic member such as ferrite, if its particle size is decreased, the degree of agglomeration increases as compared to the magnetic developing agent. For this reason, the amount of silica to be externally added must be further increased, and as a result, the number of free silica particles which are separated from toner particles increases. Therefore, a charge potential difference between the closed-cell roller and the silica must be smaller than in the case of the magnetic developing agent. For this purpose, the amount of silica dispersed in the surface of the closed-cell roller in Example 1 is 10 wt %. However, in this example, 30 wt % of silica is dispersed.

At this time, the charge amount of the developing agent is determined by a contact probability with the sleeve. In this example, since an elastic blade is used, the contact probability between the sleeve and the developing agent is high at the contact portion, and the charge amount can exhibit a sufficient value.

<EXAMPLE 3>

Example 3 of the present invention will be described below. A developing sleeve used in this example is a cylindrical one consisting of, e.g., SUS304, and its surface is subjected to, e.g., grinder working, buffing, or the like to obtain a desired diameter, thereby forming a pseudo mirror surface. Therefore, a small three-dimensional roughened surface obtained by a surface roughening treatment, e.g., sand blasting, is not formed.

The surface roughness of this sleeve is as fine as Rz=0.2 to 2.0 μm in both the circumferential and axial directions of the Sleeve. In this manner, when the pseudo mirror surface is formed on the sleeve surface, the contact probability between the sleeve and the developing agent at the contact portion of the closed-cell roller becomes remarkably higher than that in a case wherein the sleeve surface is subjected to a surface roughening treatment. For this reason, even when the triboelectric performance between the closed-cell roller and the toner is lowered due to a change in physical properties of the surface of the closed-cell roller caused by the attachment of silica in the developing agent to the surface of the closed-cell roller, the charge amount of the developing agent on the sleeve can maintain a sufficient value.

Note that the developing sleeve in this example was prepared by buffing an SUS304 cylindrical sleeve to have a surface roughness Rz of 0.8 μm.

An image forming apparatus to which the developing device according to each example of the present invention will be described below with reference to the schematic sectional view of FIG. 4.

Figure 4:
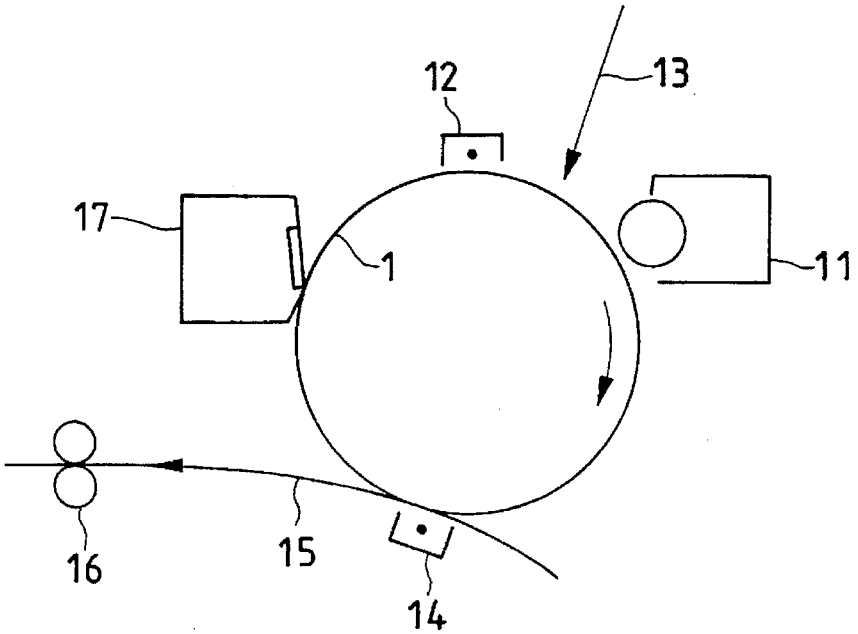
FIG. 4 is a sectional view of an image forming apparatus to which the example of the present invention can be applied.

Referring to FIG. 4, in an electrophotographic image forming apparatus, a photosensitive drum 1 as an image carrier is rotatably arranged, and is uniformly charged by a primary charger 12. Then, an information signal is exposed on the surface of the photosensitive drum 1 using a light-emitting element 13 such as a laser to form an electrostatic latent image. The latent image is visualized (developed) by a developing device 11. The visualized image is transferred onto a transfer sheet 15 by a transfer charger 14, and is fixed on the sheet by a fixing device 16 to obtain a permanent image. The residual toner on the photosensitive drum 1 after the transfer operation is removed by a cleaning device 17.

<EXAMPLE 4>

Figure 5:
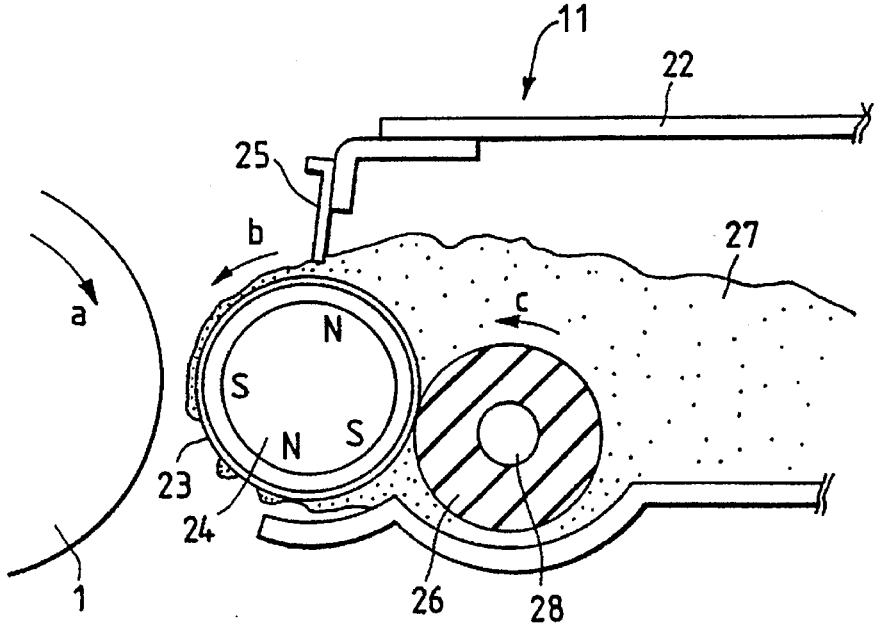
FIG. 5 is a schematic sectional view showing a developing device according to another example of the present invention.

FIG. 5 is a schematic sectional view showing Example 4 of a developing device for an image forming apparatus according to the present invention. Referring to FIG. 5, a developing device 11 has a developing container 22 in the vicinity of a photosensitive drum 1 as an image carrier, which is rotated in the direction of an arrow a in FIG. 5, and the developing container 22 contains a magnetic toner 27 as a one-component developing agent. The developing container 22 comprises a developing sleeve 23 as a developing agent carrier, which is arranged to face the photosensitive drum 1 and includes a magnet 24 as a magnetic field generating means, thereby developing an electrostatic latent image on the photosensitive drum 1 to visualize it as a toner image.

In the photosensitive drum 1, for example, a so-called xerography photosensitive body forms an electrostatic latent image by a Carlson process. An insulative body which forms an electrostatic latent image by an NP process described in Japanese Laid-Open Patent Application No. 42-23910 and has an insulative layer on its surface, or members which form an electrostatic latent image (including a potential latent image) by other proper methods is used.

The developing container 22 has an opening portion extending in the longitudinal direction (in a direction perpendicular to the plane of the drawing of FIG. 5) of the developing device 11, and the above-mentioned developing sleeve 23 is arranged in the opening portion.

The developing sleeve 23 consists of, e.g., aluminum, SUS, or the like, and is rotatably arranged to face the photosensitive drum 1, so that its right half outer circumferential surface in FIG. 5 extends into the developing container 22 via the opening, and its left half outer circumferential surface is exposed outside the developing container 22. A small gap is formed between the developing sleeve 23 and the photosensitive drum 1. The developing sleeve 23 is rotated in the direction of an arrow b with respect to the rotational direction a of the photosensitive drum 1. Note that the material and shape of the surface of the developing sleeve 23 will be described in detail later.

The developing sleeve as the toner carrier is not limited to a cylindrical member (sleeve) like the developing sleeve 23, but may be an endless belt which is rotated. Also, a conductive rubber roller may be used.

The magnet 24 is arranged in the developing sleeve 23, and comprises a fixed permanent magnet in this example. Even when the sleeve 23 is rotated, the magnet 24 maintains its fixed position and posture, and generates a fixed magnetic field.

Furthermore, in the developing container 22, a magnetic blade 25 as a developing agent regulating member is arranged so that its edge portion is located in the vicinity of a position above the developing sleeve 23. In addition, a toner supply roller 26 consisting of closed-cell foam rubber is rotatably arranged at a position at the upstream side in the rotational direction of the developing sleeve 23 of the magnetic blade 25.

In the above-mentioned arrangement of the developing device 11, the supply roller 26 is rotated in the direction of an arrow c in FIG. 5, and the magnetic toner 27 is supplied to the vicinity of the sleeve 23 by the rotation of the supply roller 26 and application of a magnetic field by the magnet 24 in the sleeve 23. When the magnetic toner 27 is brought into sliding contact with the supply roller 26 and the sleeve 23 in a nip portion where the sleeve 23 contacts the supply roller 26, the toner 27 is sufficiently triboelectrically charged, and is attached onto the sleeve 23 by an electrostatic force due to the triboelectric charging and the magnetic force from the magnet in the sleeve 23.

Thereafter, upon rotation of the developing sleeve 23, the magnetic toner 27 attached onto the developing sleeve 23 leaves a magnetic regulating portion formed in a gap between the magnetic blade 25 and the developing sleeve 23, and forms a thin layer of the magnetic toner on the developing sleeve 23. The thin layer of toner is conveyed to a developing portion which faces the photosensitive drum 1 with a small gap.

When an alternate voltage obtained by superposing an AC voltage on a DC voltage is applied as a developing bias across the developing sleeve 23 and the photosensitive drum 1 on the developing portion, the magnetic toner 27 on the developing sleeve 23 is transferred in correspondence with an electrostatic latent image on the photosensitive drum 1, and becomes attached to and develops the electrostatic latent image, thus visualizing the latent image as a toner image.

The magnetic toner 27 which remains on the developing sleeve 23 without being consumed by the developing process on the developing portion is recovered in the developing container 22 by the lower portion of the developing sleeve 23 upon rotation of the developing sleeve 23. The recovered toner 27 is removed from the developing sleeve 23 by the supply roller 26, i.e., its contact portion with the developing sleeve 23. At the same time, a new portion of the magnetic toner 27 is supplied onto the developing sleeve 23 upon rotation of the supply roller 26, and the new toner portion is conveyed to the vicinity of the magnetic blade 25 upon rotation of the developing sleeve 23. On the other hand, most of the removed toner portion is conveyed into the toner portion in the developing container 22 upon rotation of the supply roller 26, and is mixed therein, thereby dispersing triboelectric charges on the removed toner.

The developing agent in this example will be described in detail below.

The developing sleeve used in this example is a cylindrical one consisting of, e.g., SUS304, and its surface is subjected to, e.g., grinder working, buffing, or the like to obtain a desired diameter, thereby forming a pseudo mirror surface. Therefore, a small three-dimensional roughened surface obtained by a surface roughening treatment, e.g., sand blasting, is not formed.

Figure 6:
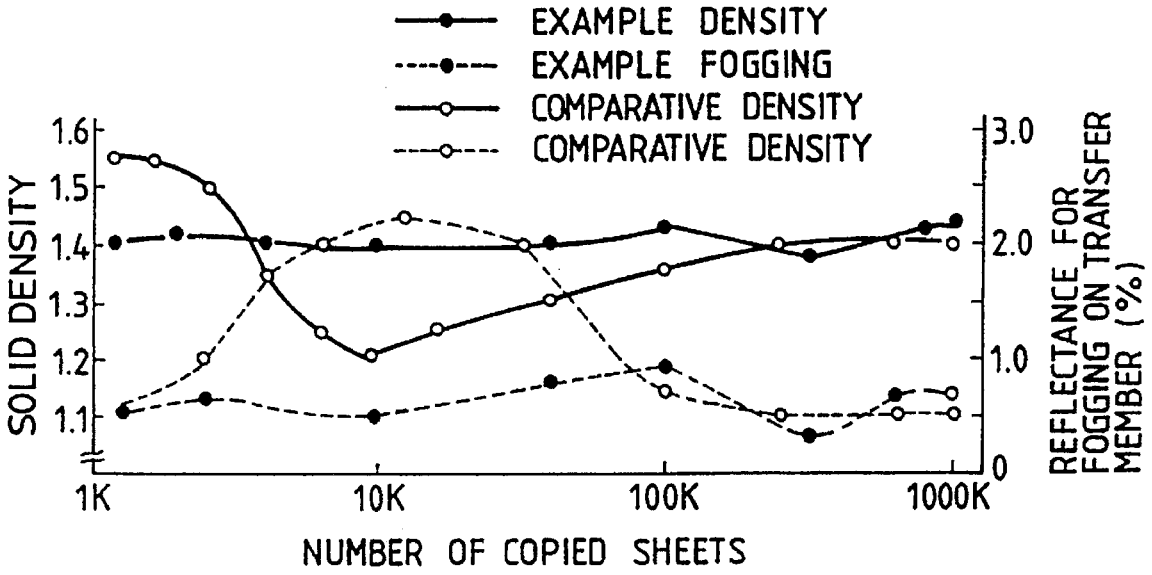
FIG. 6 is a graph showing changes in solid density and reflectance for fogging upon conduction of image output durability tests of one million images in the arrangement according to Example 4 of the present invention and the arrangement described in the paragraph of "Related Art"

FIG. 6 shows changes in solid density and reflectance for fogging after image output durability tests of one million copied sheets in a low-humidity environment using a toner having a particle size of 6 μm as a developing agent in the developing device with the arrangement of this example. FIG. 6 also shows, as a comparative example, the results of the same image output tests using a developing sleeve whose surface is subjected to a sand blasting treatment using regular beads to have a surface roughness Rz≈3.0 μm.

Figure 7:
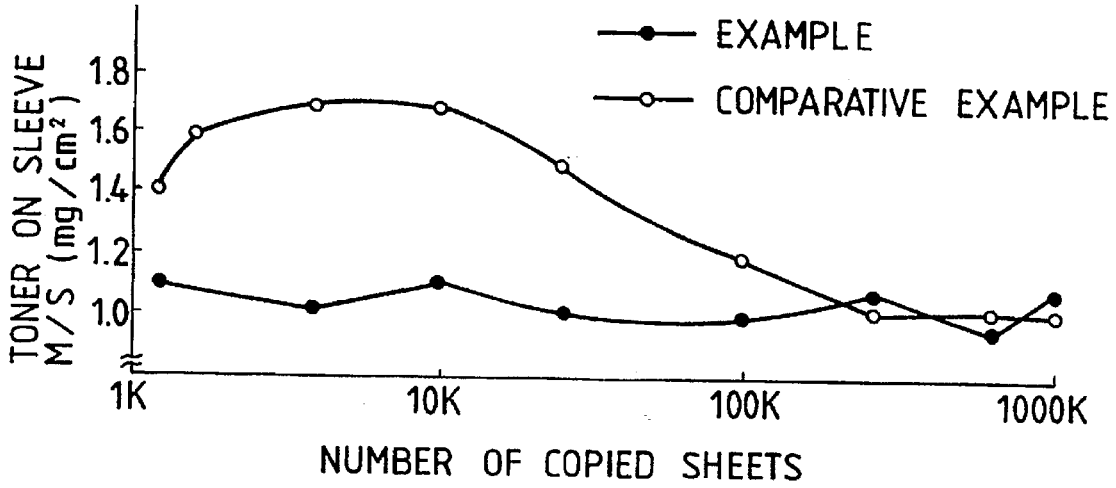
FIG. 7 is a graph showing a change in M/S of a toner layer on a sleeve upon conduction of image output durability tests of one million images in the arrangement according to Example 4 of the present invention and the arrangement described in the paragraph of "Related Art"

FIG. 7 shows a change in M/S of a toner layer on the sleeve together with that of the comparative example. As is apparent from FIGS. 6 and 7, since the sleeve with the pseudo mirror surface is used, a decrease in triboelectric charging performance of the toner caused by sleeve surface contamination with toner due to cohesion of a fine powder to the small recess portions of the sleeve after several thousand sheets are copied in the durability tests in the prior art can thus be prevented. Since no surface roughening treatment is performed, a variation in density due to a variation in M/S of the toner layer on the sleeve caused by wear of three-dimensional surface pattern as the aging progresses, or white stripes caused by clogging of a worn powder between the sleeve and the blade can be prevented. Since no surface roughening treatment is performed, the blotch phenomenon can be prevented due to the presence of the toner removing function upon contact of the closed-cell roller. Furthermore, since the triboelectric charging performance between the sleeve and the toner is high due to the mirror surface, the toner charge amount can quickly rise from an initial state, and a high-quality image can be provided even in a high-humidity environment or after the device is left unused for a long period of time.

Note that the surface roughness of the developing sleeve is preferably set to be as fine as a manufacturing process allows since a change in surface shape caused by the durability tests becomes smaller and the triboelectric charging performance of the toner is improved as the mirror surface becomes finer. If the surface roughness is expressed in units of Rz, the surface roughness Rz is set to be 2.0 μm or less, and preferably, 1.0 μm or less in both the circumferential and axial directions of the sleeve. If the surface roughness Rz exceeds 2.0 μm, the problems described in the comparative example are posed. In this example, a sleeve whose surface was worked by the above-mentioned surface working techniques had a roughness Rz=0.5.

Other arrangements used in this example will be described below.

Figure 8:
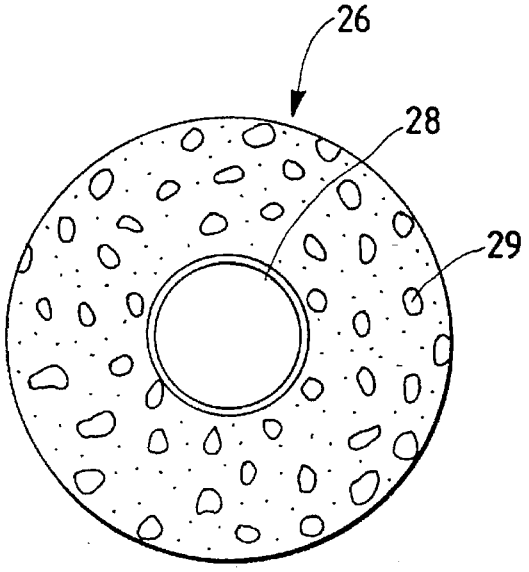
FIG. 8 is an enlarged sectional view of a toner supply roller shown in FIG. 5.

FIG. 8 is a schematic sectional view of the toner supply roller in this example. As shown in FIG. 8, a metal core 28 as a support shaft is covered by, in a roller shape, a closed-cell foam in which the wall surface of a cell portion 29 does not communicate with a neighboring cell portion, such as silicone rubber, EPDM (ethylene-propylene-diene terpolymer) rubber, CR (chloroprene rubber), neoprene rubber, or the like. The roller is rotated in the direction of an arrow c in FIG. 5, and is in sliding contact with the developing sleeve. Since the toner supply roller consisting of closed-cell foam rubber (to be simply referred to as a closed-cell roller hereinafter) is used, the actual contact area can be increased as compared to a conventional open-cell roller or fur-brush roller since its surface is dense, even when the entrance amount of toner to the developing sleeve remains the same. As a result, the toner coating/removing operation with respect to the sleeve can be satisfactorily performed.

The contact conditions of the closed-cell roller in the arrangement of this example, i.e., in a system for regulating the thickness of a toner layer on the sleeve by the magnetic blade by utilizing a magnetic field generated by a magnet roller in the sleeve and coating/removing a toner onto/from the sleeve by the closed-cell roller will be described below.

According to the experiments of the present inventors, in contrast with an allowable range in a system which does not use the effect of the magnet roller (especially, in a system using a non-magnetic toner), the present invention allows toner coating based on a magnetic force upon operation of the magnet roller and toner removal by utilizing a difference in magnetic force on the sleeve surface. Therefore, the allowable range can be widened, or a range which does not easily cause adverse effects can be set.

More specifically, the following conditions can be set:

(a) Contact width with sleeve: 0.5 to 6.0 mm (b) Roller density: 0.15 to 0.35 g/cm$^3$ (c) Roller hardness (ASKER-C, 300 g weight): 10° to 30°

(d) Number of cells on roller surface: 100 to 400 cells/inch

As for condition (a), when the contact width becomes smaller than 0.5 mm, coating nonuniformity occurs, and conversely, when the contact width becomes larger than 6.0 mm, problems of toner fusion onto the sleeve and an increase in driving torque are posed. As for condition (c), if the roller hardness becomes smaller than 10°, the sleeve is easily contaminated with leaked low-molecular oil. On the other hand, when the roller hardness becomes larger than 30°, toner fusion on the sleeve and an increase in driving torque occur due to an excessive contact force. As for conditions (b) and (d), the ranges are determined for the same reasons.

In the closed-cell roller in this example, a roller, which had an outer diameter of 14 mm was prepared by covering a 4-mm thick closed-cell foam cylinder having a hardness of 12° (ASKER-C, 300 g weight), a density of 0.25 g/cm$^3$, and 200 cells/inch around a metal core having an outer diameter of 6 mm was used. The roller was rotated in the same direction as that of the sleeve at the same speed as that of the sleeve and contacted the sleeve by a contact width of 4.0 mm.

The magnetic toner 27 is prepared by dispersing a magnetic member such as ferrite in various thermoplastic resins such as a styrene resin, an acrylic resin, a polyester resin, and the like since it is used as a magnetic one-component developing agent. In this example, the toner used was prepared by externally adding 0.6% of colloidal silica to a toner powder having an average particle size of 6 μm and consisting of a styrene/acrylic resin copolymer, a styrene/butadiene resin copolymer, and a magnetic member.

The developing device with the above-mentioned arrangement was assembled in a GP-55 copying machine available from CANON INC., and a non-contact developing operation was performed under the conditions that a voltage obtained by superposing a DC voltage of −550 V on an AC voltage having a frequency of 2,000 Hz and a peak-to-peak voltage of 1,400 V was used as a bias power supply. The surface potential of a light portion of a latent image on the photosensitive drum 1 was set to be −700 V, that of a dark portion was set to be −250 V, and the interval between the developing sleeve 23 and the photosensitive drum 1 was set to be 300 μm. As a result, a satisfactory thin toner layer could be uniformly formed on the developing sleeve, and a good image with a reflection density of 1.4 could be obtained. At this time, the charge amount of the toner was −20 μc/g, and this value is satisfactory.

Furthermore, when one million image forming operations were continuously performed while replenishing the toner for each 3,000 sheets, high-quality images free from density nonuniformity, fogging, a decrease in density, and the like could be maintained up to the last image forming operation as well as upon replenishment of the toner.

<EXAMPLE 5>

Example 5 of the present invention will be described below.

In this example, Al is used as the material of a developing sleeve, and the outer surface of the sleeve has a pseudo mirror surface. With this structure, as compared to the SUS sleeve in Example 4, the effect of the present invention can be further improved. As has been described in the description of the prior art, since the Al sleeve has a lower hardness than that of an SUS sleeve, the Al sleeve subjected to the surface roughening treatment is used. When image output operations are performed in a system in which a closed-cell roller contacts the sleeve, the surface shape of the Al sleeve changes quicker than the SUS sleeve, and sleeve coating nonuniformity occurs due to generation of a worn powder upon wear on the surface. However, these problems can be completely solved by the arrangement of this example.

Note that the surface working process can be realized by, e.g., the following methods.

(1) An aluminum ingot is heated, and is extruded from a cylindrical mold. Thereafter, the molded cylindrical member is extruded via a die with a desired diameter to have a surface roughness Rz=0.8 μm.

(2) An aluminum ingot is cut into a cylindrical shape by a cutting tool, and is ground by an abrasive to have a surface roughness Rz=0.5 μm.

Methods other than the above-mentioned two methods may be used as long as a mirror surface is formed. With this arrangement, even when the Al sleeve is used, an equivalent effect for preventing increases in density and fogging in the SUS sleeve can be provided even in image output durability tests of one million sheets in a system using a fine particle toner having a particle size of 6 μm or less. Furthermore, the Al sleeve can be manufactured with lower cost than the SUS sleeve.

<EXAMPLE 6>

Example 6 of the present invention will be described below.

Figure 9:
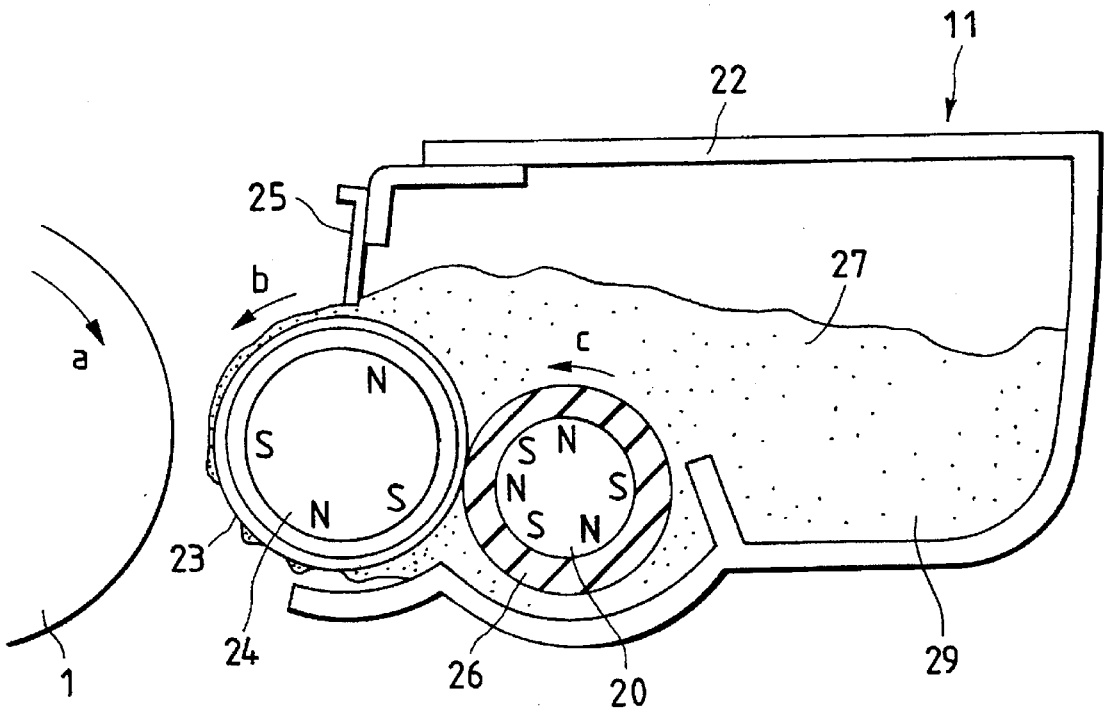
FIG. 9 is a schematic sectional view showing a developing device according to Example 6 of the present invention.

A toner supply roller in this example uses a magnet roller 20 having a plurality of magnetic poles as a magnetic field generating layer in place of the metal core in Example 4, as shown in FIG. 9, and closed-cell foam is formed on the surface of the magnet roller. With this arrangement, since a magnetic toner on a hopper 29 side can be magnetically attracted to the roller, the carrying force of the toner can be improved, and the M/S of the toner on the sleeve can be improved. Since this arrangement is effective especially when the amount of toner remaining in the hopper 29 is small, the toner replenishment interval can be prolonged.

When the magnetic force of the magnetic field generating layer of the closed-cell roller base layer is set to be stronger than the magnetic force of the magnetic pole in the vicinity of the closed-cell roller contact portion of the magnet in the sleeve, the removing force of the toner on the sleeve can be improved. On the other hand, when this magnetic force is set to be weaker, the coating function can be improved, and the M/S of the toner layer on the sleeve can be easily optimized.

In the arrangement of the closed-cell roller, the magnet roller as the base layer is rotated. Alternatively, a cylindrical closed-cell foam may be formed, and a fixed magnet may be arranged therein.

With the arrangement of this example, since the developing sleeve with the mirror surface having a finer roughness is used, the M/S of the toner base layer on the sleeve can be further stabilized as compared to Example 4.

The examples of the present invention have been described. However, the present invention is not limited to these examples, and various modifications may be made within the spirit and scope of the invention.

What is claimed is:

1. A developing device comprising:

a developing container for containing a toner and an additive;

a toner carrier disposed in an opening portion of said developing container and rotatable for carrying the toner; and a peeling member disposed in sliding contact with said toner carrier for peeling toner off of said toner carrier, wherein a triboelectric charge potential difference between the surface of said peeling member and the additive is substantially zero.

2. A device according to claim 1, wherein the toner is a one-component magnetic toner, and said toner carrier comprises magnetic field generating means having a plurality of magnetic poles.

3. A device according to claim 1, wherein the toner is a one-component non-magnetic toner.

4. A device according to claim 1, wherein a charging polarity of the toner is equal to a charging polarity of the additive.

5. A device according to claim 4, wherein the charging polarity of the toner and the charging polarity of the additive are negative.

6. A device according to claim 1, wherein the additive is silica.

7. A device according to claim 1, wherein said peeling member is a rotary member having a foamed elastic layer on a surface thereof.

8. A device according to claim 7, wherein said foamed elastic layer is a closed-cell foamed elastic layer.

9. A device according to claim 8, wherein a contact width of said foamed elastic layer with said toner carrier is 0.5 to 6.0 mm, and said foamed elastic layer has a density of 0.15 to 0.35 g/cm$^3$, a hardness (ASKER-C, 300 g weight) of 10° to 30°, and a number of cells in the range of 100 to 400 cells/inch.

10. A developing device comprising:

a developing container for containing a toner and added silica;

a toner carrier disposed in an opening portion of said developing container and rotatable for carrying the toner; and a rotary peeling member disposed in sliding contact with said toner carrier for peeling toner off said toner carrier and supplying toner to said toner carrier, wherein said rotary peeling member has a surface elastic layer in which silica is dispersed.

11. A device according to claim 10, wherein the toner is a one-component magnetic toner, and said toner carrier comprises magnetic field generating means having a plurality of magnetic poles.

12. A device according to claim 10, wherein the toner is a one-component non-magnetic toner.

13. A device according to claim 10, wherein a charging polarity of the toner is equal to a charging polarity of the additive.

14. A device according to claim 13, wherein the charging polarity of the toner and the charging polarity of the additive are negative.

15. A device according to claim 10, wherein the surface elastic layer is composed of foamed rubber.

16. A device according to claim 15, wherein said surface elastic layer is a closed-cell foamed elastic layer.

17. A device according to claim 16, wherein a contact width of said foamed elastic layer with said toner carrier is 0.5 to 6.0 mm, and said foamed elastic layer has a density of 0.15 to 0.35 g/cm$^3$, a hardness (ASKER-C, 300 g weight) of 10° to 30°, and a number of cells in the range of 100 to 400 cells/inch.

18. A developing device comprising:

a developing container for containing a toner;

a toner carrier disposed in an opening portion of said developing container and rotatable for carrying the toner, said toner carrier having a surface roughness Rz of not more than 2.0 μm in both a rotational direction and a rotational axis direction, and comprising magnetic field generating means having a plurality of magnetic poles; and a rotary peeling member disposed in sliding contact with said toner carrier for peeling toner off said toner carrier, said rotary peeling member having a foamed elastic layer on a surface thereof.

19. A device according to claim 18, wherein said toner carrier comprises ground stainless steel.

20. A device according to claim 18, wherein said toner carrier comprises extruded aluminum.

21. A device according to claim 18, wherein a surface of said toner carrier is buffed.

22. A device according to claim 18, wherein the surface roughness Rz is not more than 1.0 μm.

23. A device according to claim 18, wherein the toner is a one-component non-magnetic toner.

24. A device according to claim 18, wherein said foamed elastic layer is a closed-cell foamed elastic layer.

25. A device according to claim 24, wherein a contact width of said foamed elastic layer with said toner carrier is 0.5 to 6.0 mm, and said foamed elastic layer has a density of 0.15 to 0.35 g/cm$^3$, a hardness (ASKER-C, 300 g weight) of 10° to 30°, and a number of cells in the range of 100 to 400 cells/inch.

26. A developing device comprising:

a developing container for containing a magnetic toner;

a toner carrier disposed in an opening portion of said developing container and rotatable for carrying the toner; and a rotary toner supply member disposed in press contact with said toner carrier for supplying toner onto said toner carrier, said rotary toner supply member comprising a surface layer consisting of a foamed elastic member, and a magnetic field generating member arranged inside said surface layer.

27. A device according to claim 26, wherein said magnetic field generating member comprises a magnet roller having a plurality of magnetic poles.

28. A device according to claim 26, wherein said foam elastic member is a closed-cell foamed elastic member.

* * * * *

UNITED STATES PATENT AND TRADEMARK OFFICE

CERTIFICATE OF CORRECTION

PATENT NO. : 5,666,620

DATED : Sept. 9, 1997

INVENTOR(S) : KOBAYASHI

It is certified that error appears in the above-identified patent and that said Letters Patent is hereby corrected as shown below:

On the title page item

[56] References Cited
FOREIGN PATENT DOCUMENTS

"4223910 11/1942 Japan" should read --42-23910 11/1967 Japan--.

Column 1

Line 24, "toner thin" should read --thin toner--;
Line 39, "have" should read --have been--;
Line 41, "a then" should read --then a--;
Line 56, "the toner" should read --toner--;
Line 66, "coating" should be deleted; and
Line 67, "the of" should read --of the--.

Column 2

Line 5, "and" should be deleted;
Line 6, "and" should be deleted; and
Line 46, "with a" should read --with the--.

Column 4

Line 27, "wore" should read --worn--; and
Line 37, "the worn" should read --worn--.

UNITED STATES PATENT AND TRADEMARK OFFICE

CERTIFICATE OF CORRECTION

PATENT NO. : 5,666,620

DATED : Sept. 9, 1997

INVENTOR(S) : KOBAYASHI

It is certified that error appears in the above-identified patent and that said Letters Patent is hereby corrected as shown below:

Column 8

Line 11, "as the" should read --in the--.

Column 9

Line 22, "send" should read --sand--.

Column 10,

Line 49, "Sleeve." should read --sleeve.--; and
Line 55, "triboelectric" should read --triboelectric charging--.

Signed and Sealed this

Thirty-first Day of March, 1998

Bruce Lehman

*Attest:*

BRUCE LEHMAN

*Attesting Officer*

*Commissioner of Patents and Trademarks*